US009067090B2

(12) United States Patent
Henry

(10) Patent No.: US 9,067,090 B2
(45) Date of Patent: Jun. 30, 2015

(54) PORTABLE APPARATUS FOR GENERATING FOAM

(75) Inventor: Darren Sean Henry, Hayden, ID (US)

(73) Assignee: Forced Gas Technologies, LLC, Greenville, SC (US)

( * ) Notice: Subject to any disclaimer, the term of this patent is extended or adjusted under 35 U.S.C. 154(b) by 484 days.

(21) Appl. No.: 13/493,437

(22) Filed: Jun. 11, 2012

(65) Prior Publication Data

US 2012/0312566 A1 Dec. 13, 2012

Related U.S. Application Data

(60) Provisional application No. 61/495,542, filed on Jun. 10, 2011.

(51) Int. Cl.

| | |
|---|---|
| ***A62C 35/00*** | (2006.01) |
| ***A62C 5/02*** | (2006.01) |
| ***A62C 13/00*** | (2006.01) |
| ***B05B 9/04*** | (2006.01) |
| ***A62C 13/66*** | (2006.01) |
| ***B05B 7/04*** | (2006.01) |

(52) U.S. Cl.

CPC ..... *A62C 5/02* (2013.01); *A62C 13/003* (2013.01); *B05B 9/04* (2013.01); *A62C 13/66* (2013.01); *B05B 7/04* (2013.01)

(58) Field of Classification Search

CPC ..... A62C 5/02; A62C 5/002; A62C 13/003; A62C 13/66; B05B 7/04; B05B 7/0466; B05B 9/04

USPC ..... 169/14, 15, 30, 71, 85; 239/398, 432, 239/373

See application file for complete search history.

(56) References Cited

U.S. PATENT DOCUMENTS

| | | | | |
|---|---|---|---|---|
| 3,045,761 | A * | 7/1962 | Ciarlo | 169/71 |
| 4,289,207 | A * | 9/1981 | Wernert | 169/30 |
| 5,409,067 | A * | 4/1995 | Esposito et al. | 169/70 |

* cited by examiner

*Primary Examiner* — Steven J Ganey

(74) *Attorney, Agent, or Firm* — McNair Law Firm, P.A.; Douglas W. Kim

(57) ABSTRACT

This invention is directed to a portable foaming apparatus for a handheld fire suppression system having a container holding a foaming agent, water and a pressurized gas, a foam generating assembly having a snorkel, a gas re-directional opening defined in the foam generating assembly allowing gas to enter the re-directional opening from the container; a nozzle in fluid communication with the gas re-directional opening and included in the foam generating assembly downstream of the snorkel so that gas entering the re-directional opening is inserted in the foam generating assembly downstream the snorkel; and, an outlet defined in the housing ejecting foam produced from the foaming agent and the gas when a foam nozzle attached to the foam generating assembly is actuated.

17 Claims, 11 Drawing Sheets

PORTABLE APPARATUS FOR GENERATING FOAM

CLAIM OF PRIORITY

This application claims priority on U.S. Provisional Patent Application Ser. No. 61/495,542 filed Jun. 10, 2011.

FIELD OF THE INVENTION

This invention is directed to a method and apparatus for generating foam using pressurized gas and a foaming agent through a mixing chamber.

BACKGROUND OF THE INVENTION

It is well known that the application of foam is useful in many industries from shaving cream, to food products to fire suppression. The quality of the foam, the liquid to gas ratio of the foam, the ability to use non-combustible gases, the ability to use non-corrosive and inert foaming agent, the ability to produce a biodegradable inert and safe for human contact foam and the distance that the foam can be sprayed and ultimate use are factors relevant to the design and operation of foaming apparatus.

Carroll et al., U.S. Pat. No. 5,058,809, is representative of a foam generating nozzle designed to aspirate ambient air into a flowing aqueous stream containing a foam producing agent. Foam is produced and discharged from the outlet of the nozzle. It is also known to incorporate a deflection or impingement structure in a foam-generating nozzle to facilitate mixing and increase foam production, as shown in Nysted, U.S. Pat. No. 4,330,086.

In the fire suppression industry, there are a number of drawbacks associated with foam generating nozzles. Since air contains oxygen, foam generated from using air as the gas is not ideal for smothering a fire. Also, many of the nozzles operate as ejectors, that is, the kinetic energy of the flowing aqueous stream is used to draw air into the nozzle. The principle of conservation of momentum results in a decrease in the velocity of the aqueous stream. Furthermore, deflection and impingement structures provided in the nozzle can increase the resistance to fluid flow through the nozzle.

Urquhart et al., U.S. Pat. No. 2,106,043, discloses a method for generating foam in which a non-combustible gas is mixed with an aqueous foam forming mixture in a foam forming chamber. The entering gas is distributed in the foam forming chamber under pressure, wherein the pressure of the gas is sufficient to carry the foam from the chamber through the hose and nozzle attached thereto. The gas is introduced perpendicular to the flow of the aqueous mixture.

Foam-generating devices having a mixing manifold in which the gas is injected at an angle of less than 90 degrees relative to the flow direction of the foam forming liquid solution, are disclosed in Mahrt, U.S. Pat. No. 5,881,817, and Henry, U.S. Pat. No. 6,112,819. Neither of the aforementioned references, however, contains jets or other means to increase the velocity of the foam-forming liquid, prior to the foam-forming liquid making contact with the gas being injected into the mixing manifold.

However, none of these attempts at a method and apparatus for generating foam are efficient, cost effective to manufacture or use atomizing and turbulence for the manufacturer of foam in a mixing chamber.

Therefore, it is an object of this invention to manufacturer an efficient, pressure operated, foam generating method and apparatus.

SUMMARY OF THE INVENTION

The above objectives are accomplished according to the present invention by providing a portable foaming apparatus for a handheld fire suppression system comprising: a container having a container opening and containing a foaming agent and a pressurized gas disposed above the foaming agent; a foam generating assembly having a housing removable attached to the container opening and having a proximal end and a distal end; a mixing chamber defined by the housing and disposed in the interior of the housing; a snorkel attached to the proximal end of the housing and received in the container having a lower end submerged in the foaming agent; a snorkel opening defined in the housing allowing foaming agent to be inserted into the mixing chamber at the proximal end of the housing; a gas re-directional opening defined in the housing allowing gas to enter the re-directional opening from the container; a nozzle in fluid communications with the gas re-directional assembly and disposed in the interior of the mixing chamber downstream of the snorkel opening so that gas entering the re-directional opening is inserted in the mixing chamber under pressure and downstream the snorkel opening wherein the gas is inserted in the mixing chamber at an angle less than 45° relative to the fluid flow; and, an outlet defined in the housing for ejecting foam produced in the mixing chamber from the foaming agent and the inserted pressurized when a foam nozzle is actuated.

The container can include between 0.75 and 1.25 pints of foaming agent, between 10 $ft^3$ and 20 $ft^3$ of nitrogen measured between 2000 psi and 2500 psi and between 1.5 and 2.5 gallons of water and the foam can achieve an expansion ratio between 15:1 and 25:1. The foam can be ejected from the housing at between 100 and 200 psi. In one embodiment, at least 45 gallons of foam is produced.

A foam restriction can be included in the snorkel opening for increasing the velocity of foaming agent entering the mixing chamber. A flow restriction cap can also be disposed at the lower end of the snorkel for restricting the flow rate of the foaming agent entering the snorkel. The flow restriction cap includes a variable aperture and the aperture can widen as the pressure in the container drops. An end cap can be removable attached to a distal end of the foam generating assembly. An overpressure assembly can be included in the foam generating assembly.

A value actuator can be including in the gas delivery line opening; and, a pressure valve included in the gas delivery line opening so that when a gas line is inserted into the delivery gas line opening, the value actuator opens the pressure valve allowing pressurized gas from the external source to flow into the container through the gas re-directional opening. A gas screen can be disposed in the gas delivery line opening and a foam screen disposed at the snorkel opening.

DESCRIPTION OF THE DRAWINGS

The construction designed to carry out the invention will hereinafter be described, together with other features thereof. The invention will be more readily understood from a reading of the following specification and by reference to the accompanying drawings.

DETAILED DESCRIPTION OF THE INVENTION

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits and advantages of the present invention will be apparent from this summary and certain embodiments described below, and will be readily apparent to those skilled in the art. Such objects, features, benefits and advantages will be apparent from the above in conjunction with the accompanying examples, data, figures and all reasonable inferences to be drawn therefrom, alone or with consideration of the references incorporated herein. With reference to the drawings, the invention will now be described in more detail.

Figure 1:
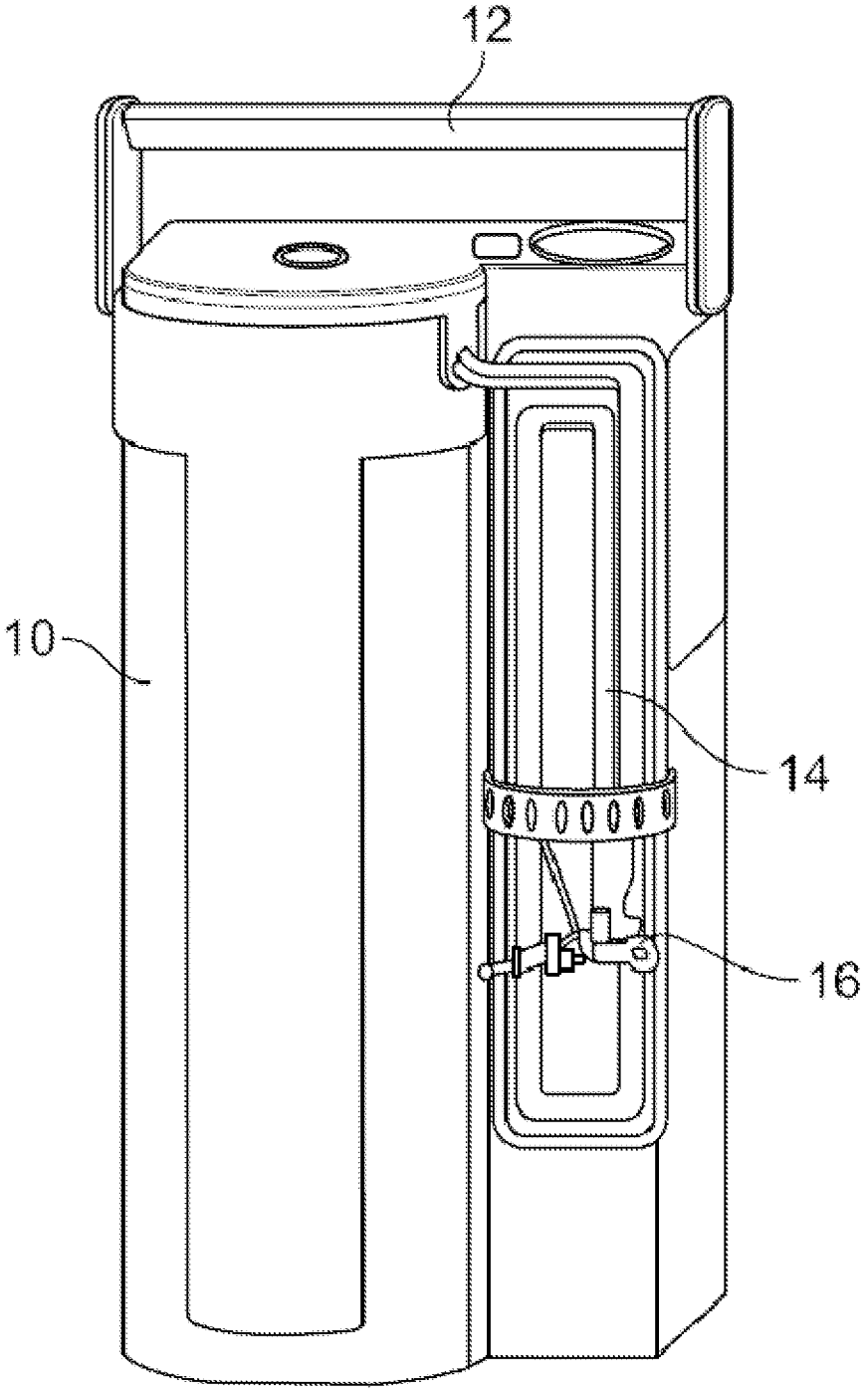
FIG. 1 is a perspective frontal view of a portion of the invention.
Figure 2:
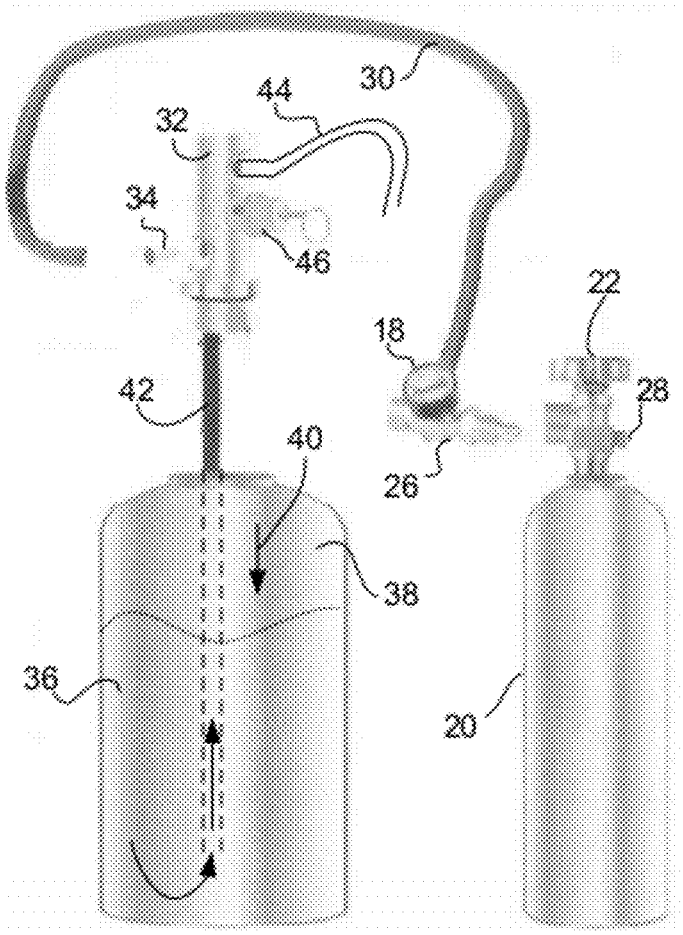
FIG. 2 is a view of several portions of the invention.

Referring to FIG. 1, a housing 10 includes a carrying handle 12. Discharge hose 14 is carried by the housing and is connected to a foam nozzle 16. Referring to FIG. 2, a gauge 18 is connected to a pressurized container 20. A valve 22 is used to open and close pressurized container 20 to either prevent or allow gas to escape the pressurized container as well as to control the flow rate of the gas escaping the pressurized container. Flow indicator 24 can be included to inform the use of the flow rate of pressurized gas escaping the pressurized container.

Figure 3:
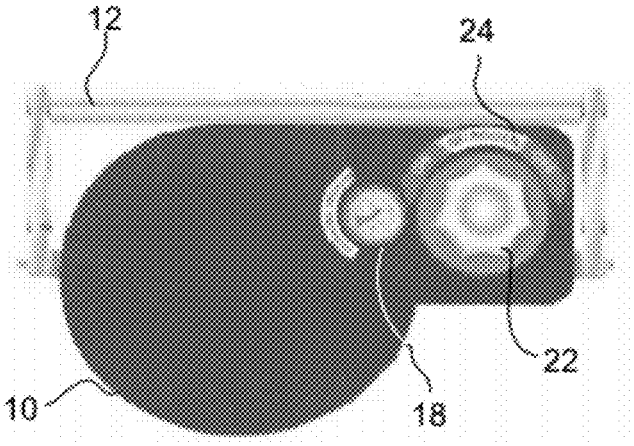
FIG. 3 is a top view of a portion of the invention.

Referring to FIG. 3, a pressurized gas container connector 26 can carry the gauge and is connected to the pressurized container. In one embodiment, the pressurized gas container connector is connected to the valve of the pressurized gas container. The pressurized gas container connector can also be used to fill or refill the pressurized container when needed. In one embodiment, valve 22 includes a valve burst disk 28 which will open when the pressurized container contains an undesirably high pressure to help prevent a rupture of the pressurized gas container. The pressurized gas container can be included in the housing.

In one embodiment, the pressurized gas is nitrogen. In one embodiment, the pressurized gas is an inert gas. In one embodiment, the pressurized gas is air.

Gas delivery line 30 is connected to pressurized gas container connector and to foam generating assembly 32. The foam generating assembly is connected to foam agent container 36 which contains foaming liquid and can receive pressurized gas. A gas nozzle insert 34 can be received by the foam generating assembly to direct pressurized gas from gas delivery line into the mixing chamber of the foam generating assembly. The foam mixing assembly also directs gas into the foam agent container so that space 38 become pressurized. The pressure of the gas being forced into space 38 applies force against the foaming agent in a direction shown as 40 thereby forcing foaming agent up through snorkel 42 and into the foam generating assembly. The foam agent is mixed with the pressurized gas and the resulting foam exits the foam generating assembly through output line 44. An overpressure assembly 47 can be connected to an overpressure assembly opening 48 and included in the foam generating assembly to help prevent the foam agent container and foam generating assembly from exceeding a desired pressure or rupturing.

In one embodiment, the foaming agent is available under the produce name FireAde2000. In one embodiment, 1 pint of the foaming agent FireAde2000 is including in the container along with 2 gallons of water and 16 $ft^3$ of nitrogen under pressure between 1500 to 2500 psi. This configuration can provide a stream of foam up to 35 ft in distance away from the user for between 30 seconds and 2 minutes with an expansion ration between 1:1 and 25:1 at an operating pressure between 75 psi and 300 psi and can provide up to 55 gallons of foam.

Figure 4:
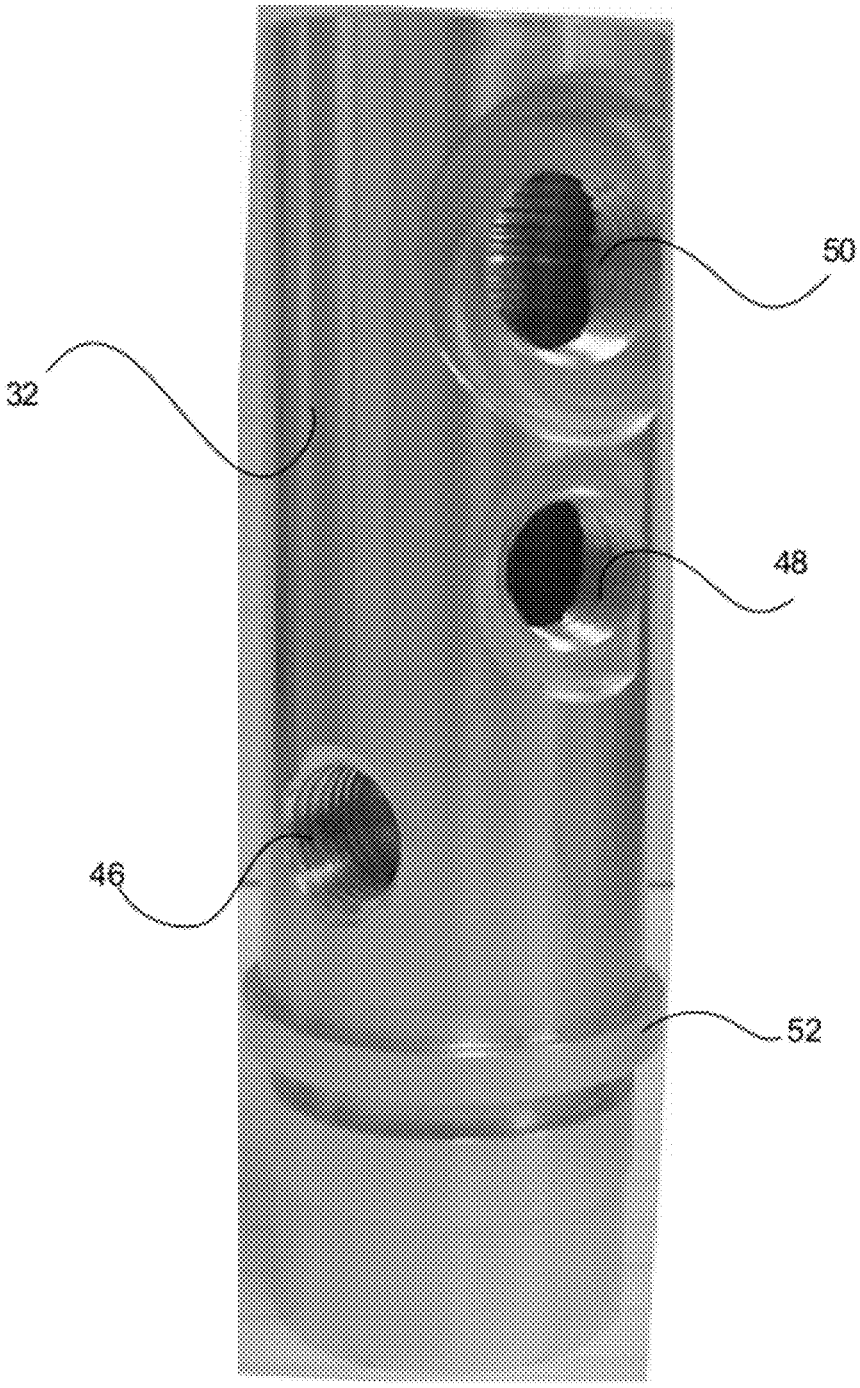
FIG. 4 is a perspective view of a portion of the invention.

Referring to FIG. 4, the foam generating assembly 32 is shown with gas delivery line opening 46 for receiving the gas delivery line and connecting it to the foam generating assembly. The gas nozzle insert can be received into the gas delivery line opening. Overpressure assembly opening 48 can be included to receive the overpressure assembly so that it can be connected to the foam generating assembly. Output line opening 50 can be included in the foam generating assembly for connecting the output line. Retaining ring 52 can be included in foam generating assembly for securing the foam generating assembly to the foam agent container.

Figure 5:
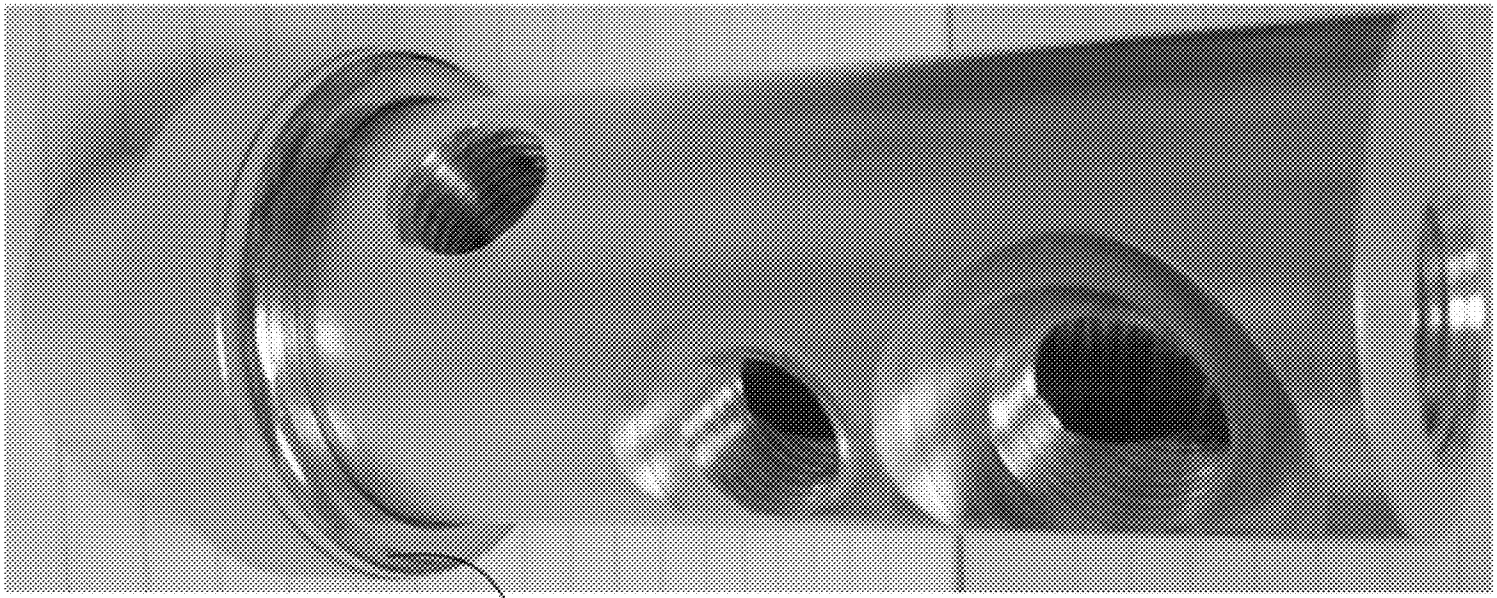
FIG. 5 is a perspective view of a portion of the invention.
Figure 6:
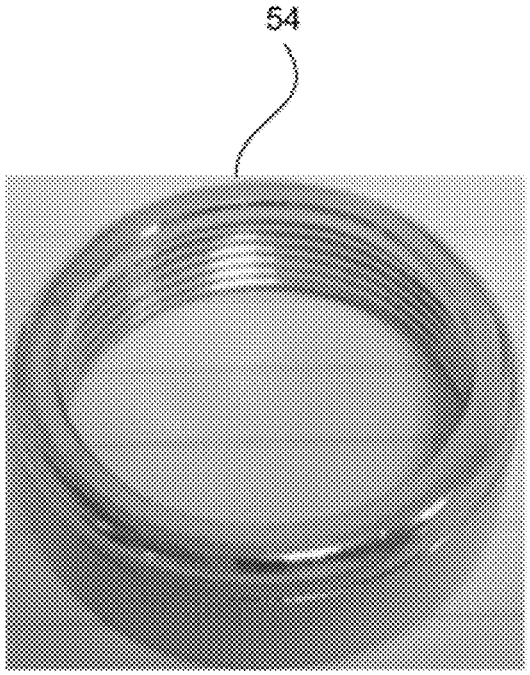
FIG. 6 is a perspective view of a portion of the invention.

Referring to FIG. 5, the foam generating assembly is shown with the securing nut 54 (FIG. 6) disposed around the foam generating container. The securing nut can rotate about the foam generating assembly and be connected to the foam agent container by operably associating with the retaining ring. In one embodiment, the securing nut is threaded to be secured to the foam agent container.

Figure 7:
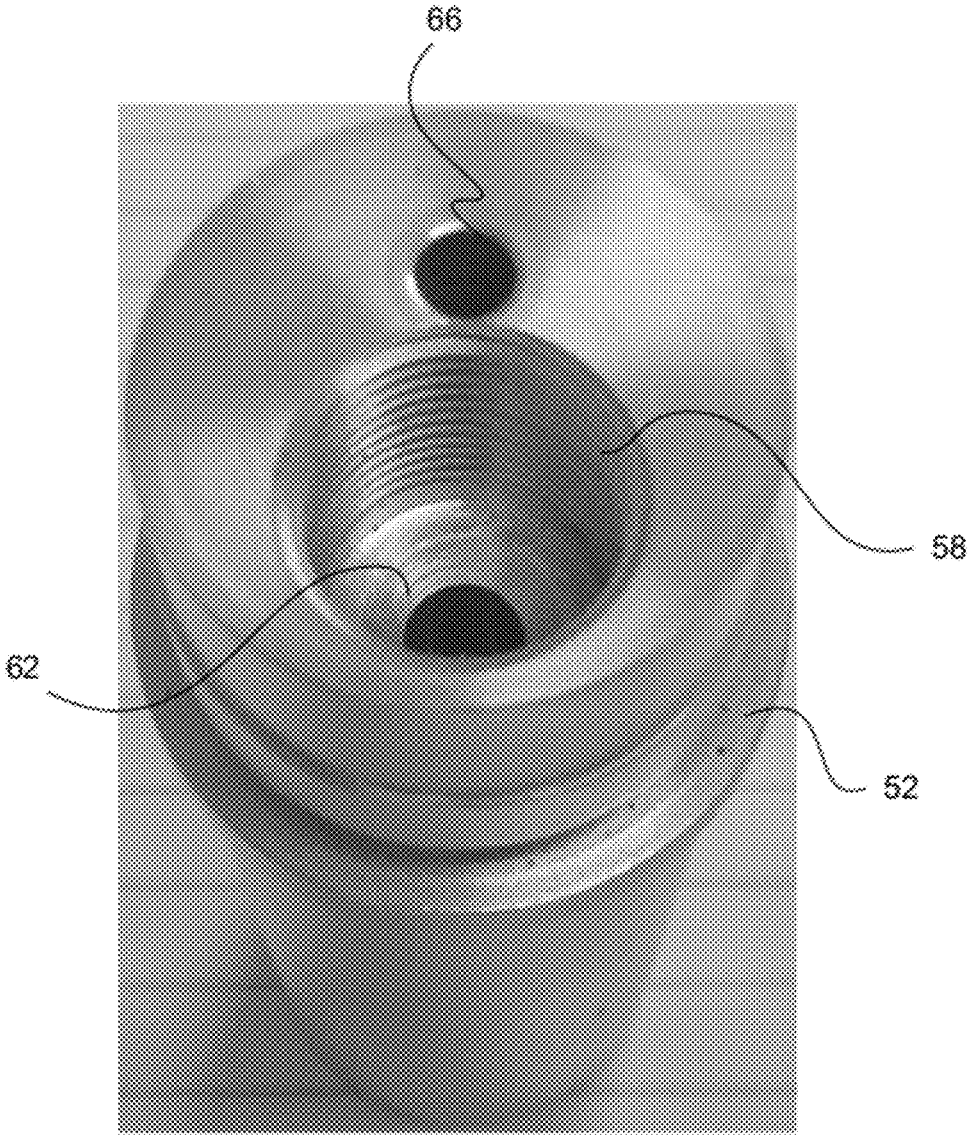
FIG. 7 is a perspective view of a portion of the invention.

Referring to FIG. 7, the end of the foam generating assembly that is associated with the foam generating container is shown. Snorkel opening 58 is defined in the foam generating assembly for receiving a snorkel 60 (Figure that can be disposed in the foam agent container. A foam agent restriction 62 can be included in the foam generating assembly to increase the flow rate of the foam agent forced through the foam agent restriction by pressurized gas. Gas re-directional opening 66 allows pressurized gas to enter the foam generating assembly and force the foam agent into the mixing chamber.

Figure 8:
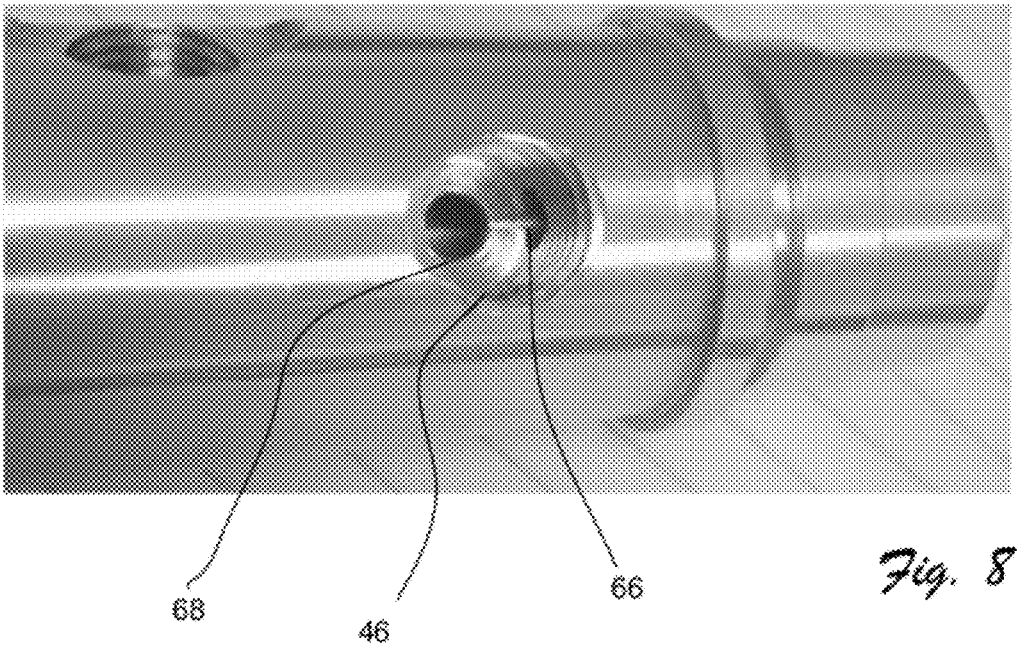
FIG. 8 is a perspective view of a portion of the invention.
Figure 9:
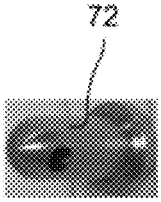
FIG. 9 is a perspective view of a portion of the invention.
Figure 10:
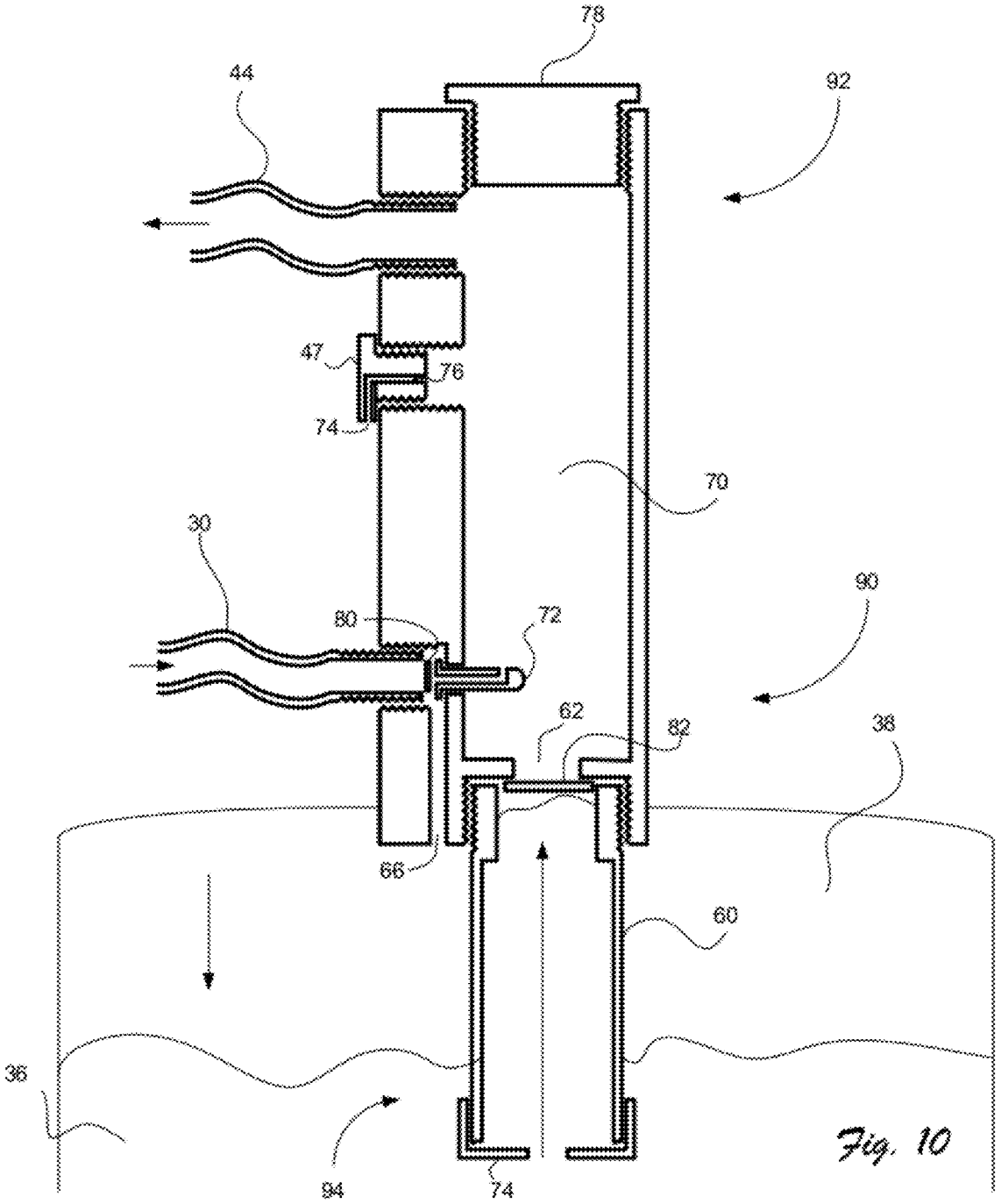
FIG. 10 is a cross-section of a portion of the invention.

Referring to FIG. 8, gas delivery line opening 46 is connected to gas re-directional opening 66. When gas from the gas container is delivered through the gas delivery line to the foam generating assembly, a portion of the gas is re-directed to the gas re-directional opening and travels to the foam agent container thereby pressurizing the foam agent container. Nozzle opening 68 can be defined in the gas delivery line opening to allow gas to enter the mixing chamber 70 (FIG. 10). Nozzle 72 (FIG. 9) can be received by the nozzle opening and can modify the travel path of the gas in the mixing chamber so that it is inserted into the mixing chamber parallel to the flow of the foaming agent, rather than perpendicular to the flow path of the foaming agent.

Referring to FIG. 10, pressurized gas enters the foam generating assembly. A portion of the gas is redirected into the foam agent container thereby forcing the foam agent up through the snorkel. The foaming agent is then forced into the foam generating assembly. The foam generating assembly can include a foam agent restriction which can increase the flow rate of the foam agent entering the mixing chamber 70. By varying the flow rate of the pressurized gas entering the foam generating assembly, the ratio of foam to pressurized gas can be altered. The flow rate of the foaming agent entering the mixing chamber can be varied by modifying the flow rate of the gas through valve 22 (FIG. 1). Further, the foam agent restriction can be varied to have different mixed or shaped opening, and can even include multiple opening to vary the flow rate of the foaming agent. In one embodiment, flow restriction cap 74 can be added to the lower end 94 of the snorkel to vary the amount of foaming agent that can enter the snorkel and therefore vary the flow rate of the foaming agent. In one embodiment, the flow restriction cap includes an opening having a aperture which can be varied. When the container contains a higher pressure when full, the pressure places a force on the exterior of the flow restriction can thereby reducing the size of the aperture. As the pressure decreases in the container when the foaming agent and gas flows into the housing, the force on the flow restriction cap is lessened and the aperture can widen allowing thereby normalizing the flow of foaming agent into the mixing changer resulting in a more uniform volume of foaming agent being inserted in the mixing chamber as the pressure in the container drops.

In one embodiment, the nozzle can be replaced with nozzles having various different sized openings, various openings or a pattern of openings (symmetrical or asymmetrical) to vary the flow of gas into the mixing chamber. When foaming agent enters the mixing chamber, it interacts with the pressurized gas being inserted through the nozzle and foam is generated to be expelled through output line 44.

In one embodiment, overpressure assembly 48 can be a burst disk having an opening 74 and diaphragm 76 that ruptures once a predetermined amount of pressure is exerted on it. An end cap 78 can be included in the foam generating apparatus at a distal end to the foam agent container to allow for opening the mixing chamber for service or maintenance. In one embodiment, the end cap, overpressure assembly, gas delivery line, snorkel, and output line can be attached to the foam generating assembly by securing threads.

Figure 11:
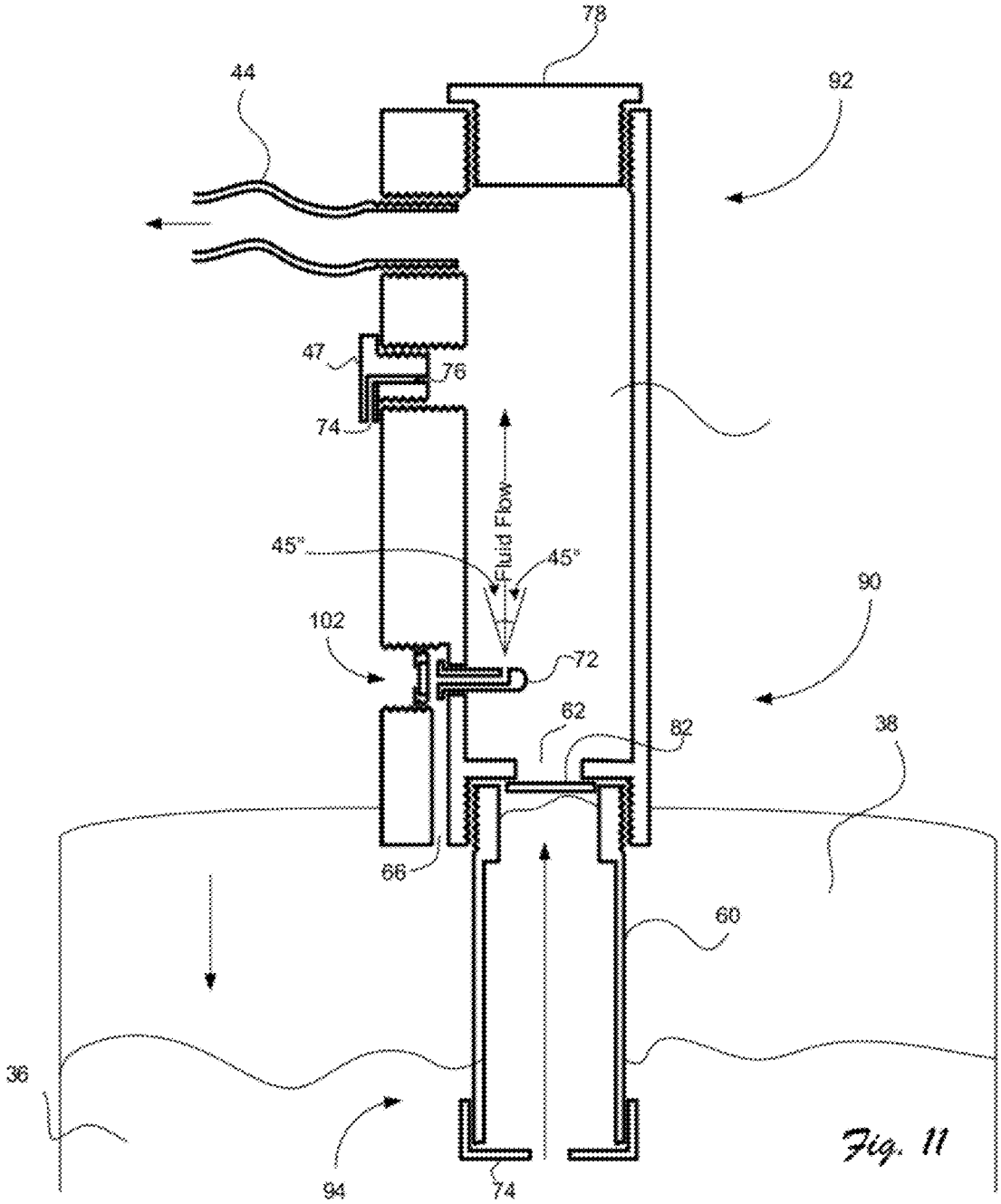
FIG. 11 is a cross-section of a portion of the invention; and,
FIG. 12 is a cross-section of a portion of the invention.
Figure 12:
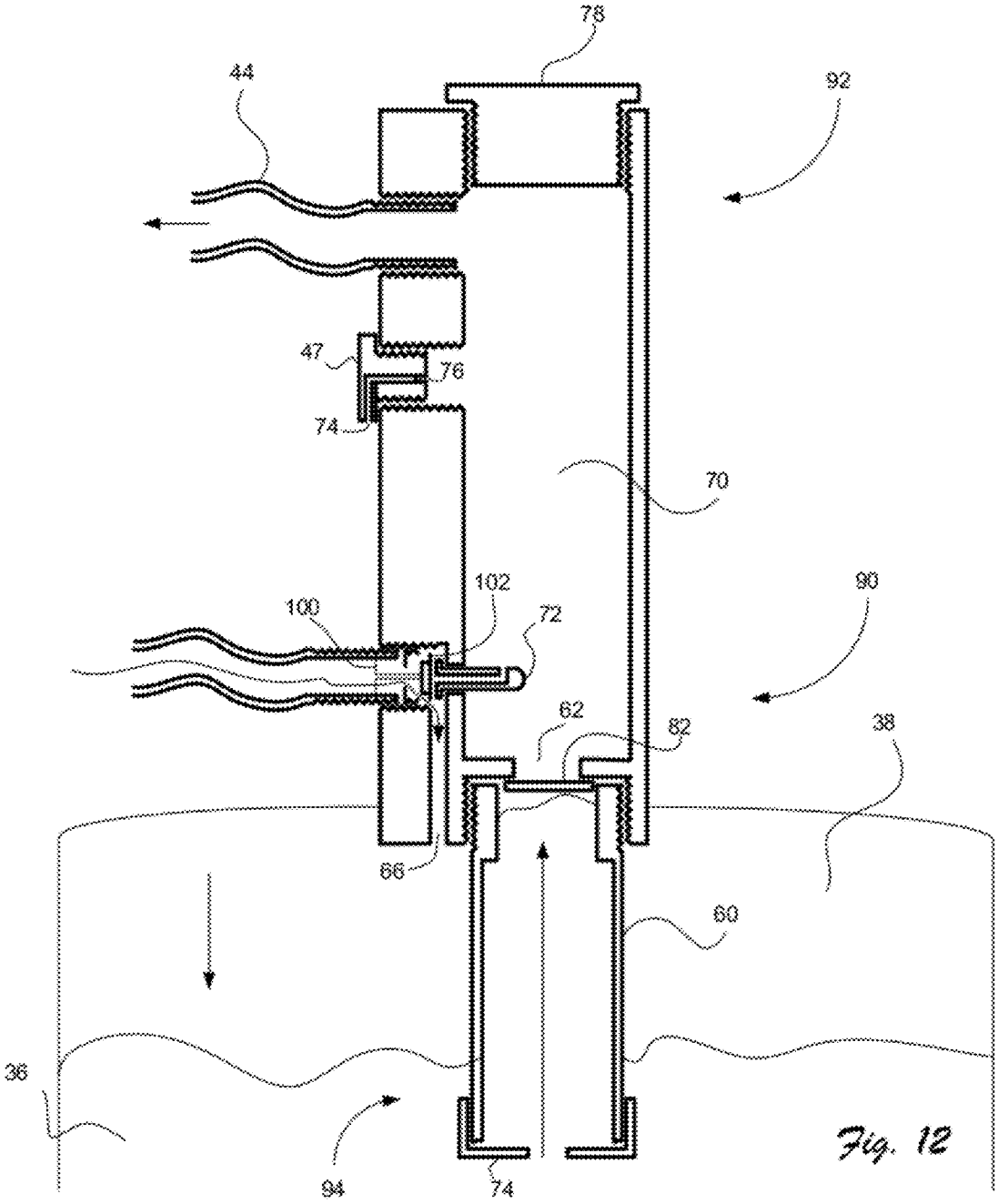

In one embodiment, gas screen 80 can be placed over the nozzle to modify the pressurized gas flow into the mixing chamber. In one embodiment, foam agent screen 82 can be inserted in the snorkel or snorkel opening to modify the flow of foaming agent into the mixing chamber. Referring to FIG. 11, when gas hose 30 is detached from said housing (i.e. after the container has been pressurized), re-pressurization valve 98 is closed thereby sealing the opening hose 30. When hose 30 is attached to pressurize the container, a value actuator 100 will open pressure value 102 allowing gas to travel from an external pressurized gas source through the re-directional opening and into the container.

While a preferred embodiment of the invention has been described using specific terms, such description is for illustrative purposes only, and it is to be understood that changes and variations may be made without departing from the spirit or scope of the following claims.

What is claimed is:

1. A portable foaming apparatus for a handheld fire suppression system comprising:

a container having a container opening and containing a foaming agent and a pressurized gas disposed above said foaming agent;

a foam generating assembly having a housing removable attached to said container opening and having a proximal end and a distal end;

a mixing chamber defined by said housing and disposed in the interior of said housing;

a snorkel attached to said proximal end of said housing and received in said container having a lower end submerged in said foaming agent;

a snorkel opening defined in said housing allowing foaming agent to be inserted into said mixing chamber at said proximal end of said housing;

a gas re-directional opening defined in said housing allowing gas to enter said re-directional opening from said container;

a nozzle in fluid communications with said gas re-directional assembly and disposed in the interior of said mixing chamber downstream of said snorkel opening so that gas entering said re-directional opening is inserted in said mixing chamber under pressure and downstream said snorkel opening wherein said gas is inserted in said mixing chamber at an angle less than 45° relative to said fluid flow; and, an outlet defined in said housing for ejecting foam produced in said mixing chamber from said foaming agent and said inserted pressurized when a foam nozzle is actuated.

2. The apparatus of claim 1 including between 0.75 and 1.25 pints of foaming agent, between 10 $ft^3$ and 20 $ft^3$ of nitrogen measured between 2000 psi and 2500 psi and between 1.5 and 2.5 gallons of water.

3. The apparatus of claim 2 wherein said foam achieves an expansion ratio between 15:1 and 25:1.

4. The apparatus of claim 2 wherein said foam is ejected from said housing at between 100 and 200 psi.

5. The apparatus of claim 2 wherein at least 45 gallons of foam is produced.

6. The apparatus of claim 1 having a foam restriction including in said snorkel opening for increasing the velocity of foaming agent entering said mixing chamber.

7. The apparatus of claim 1 having a flow restriction cap disposed at said lower end of said snorkel for restricting the flow rate of said foaming agent entering said snorkel.

8. The apparatus of claim 7 wherein said flow restriction cap includes a variable aperture.

9. The apparatus of claim 8 wherein said aperture widens as said pressure in said container drops.

10. A portable foaming apparatus for a handheld fire suppression system comprising:

a container containing a foaming agent and a gas under pressure;

a foam generating assembly attached to said container having;

a snorkel included in said foam generating assembly received in said container having a lower end submerged in said foaming agent;

a snorkel opening defined in said housing allowing foaming agent to be inserted into said foam generating assembly from said container;

a gas re-directional opening included in said foam generating assembly allowing gas to enter said re-directional opening from said container;

a nozzle in fluid communication with said gas re-directional opening and attached to the interior of said foam generating assembly downstream of said snorkel opening so that gas entering said re-directional opening is inserted in said foam generating assembly under pressure and downstream said snorkel opening wherein said gas is inserted in said mixing chamber at an angle less than 45° relative to said fluid flow; and, an outlet defined in said foam generating assembly ejecting foam produced from said foaming agent and said pressurized gas.

11. The apparatus of claim 10 including an end cap removable attached to a distal end of said foam generating assembly.

12. The apparatus of claim 10 including an overpressure assembly included in said foam generating assembly.

13. The apparatus of claim 10 including a gas delivery line opening in fluid communication with said gas re-directional opening for receiving a gas delivery line so that said container can be pressurized with gas from an external source.

14. The apparatus of claim 13 including:

a value actuator including in said gas delivery line opening; and, a pressure valve included in said gas delivery line opening so that when a gas line is inserted into said delivery gas line opening, said value actuator opens said pressure valve allowing pressurized gas from said external source to flow into said container through said gas re-directional opening.

15. The apparatus of claim 10 wherein said container contains between 0.75 and 1.25 pints of foaming agent, between 10 $ft^3$ and 20 $ft^3$ of nitrogen measured at between 2000 psi and 2500 and between 1.5 and 2.5 gallons of water.

16. The apparatus of claim 10 including a gas screen disposed in said gas delivery line opening and a foam screen disposed at said snorkel opening.

17. The apparatus of claim 10 including a foam restriction defined by said foam generating assembly.

* * * * *